US005490530A

United States Patent [19]

Snowden

[11] Patent Number: 5,490,530

[45] Date of Patent: Feb. 13, 1996

[54] DISPOSABLE TOOTHCARE ASSEMBLY

[76] Inventor: Patricia Snowden, 3003 Windchase Apt. 706, Houston, Tex. 77082

[21] Appl. No.: 237,295

[22] Filed: May 3, 1994

[51] Int. Cl.[6] ..... A46B 11/02

[52] U.S. Cl. ..... 132/311; 132/308; 401/268; 401/280

[58] Field of Search ..... 132/311, 309, 132/308; 15/167.1; 401/156, 184, 268, 280

[56] References Cited

U.S. PATENT DOCUMENTS

| | | | |
|---|---|---|---|
| 1,610,831 | 12/1926 | Wallace | 132/311 |
| 1,859,402 | 5/1932 | Maher . | |
| 2,053,145 | 9/1936 | Hamel | 132/311 X |
| 2,303,667 | 12/1942 | Taborski | 132/308 X |
| 2,527,741 | 10/1950 | Lamonde . | |
| 2,592,099 | 4/1952 | Ackerman | 132/308 X |
| 2,978,722 | 4/1961 | Kusakabe | 132/311 X |
| 3,353,898 | 11/1967 | Lamberti | 132/308 X |
| 3,782,397 | 1/1974 | McCord | 132/311 X |
| 4,530,369 | 7/1985 | Adams | 132/311 |
| 4,580,588 | 4/1986 | Swope, Jr. | 132/311 |
| 4,583,563 | 4/1986 | Turner | 132/311 |
| 4,622,984 | 11/1986 | Gaebel | 132/308 |
| 4,957,125 | 9/1990 | Yaneza . | |
| 5,040,553 | 8/1991 | Londono et al. | 132/311 |
| 5,181,531 | 1/1993 | Escoto et al. | 132/308 |

*Primary Examiner*—John G. Weiss
*Attorney, Agent, or Firm*—Terry M. Gernstein

[57] ABSTRACT

A toothcare assembly includes a handle having a dental floss dispensing assembly on one end and tooth brushing bristles mounted thereon adjacent to a head end. A chamber for storing toothpaste is defined in the head end, and dispensing holes connect the chamber to the surface of the head adjacent to the bristles. A flexible diaphragm is mounted on the head adjacent to the chamber and, when pressed, forces toothpaste through the dispensing holes into contact with the bristles. A chamber closing element is slidably mounted on the head to cover the dispensing holes in the chamber to prevent toothpaste from moving through the dispensing holes, and is slidably moved out of hole-covering position when it is desired to dispense toothpaste.

7 Claims, 2 Drawing Sheets

DISPOSABLE TOOTHCARE ASSEMBLY

TECHNICAL FIELD OF THE INVENTION

The present invention relates to the general art of dental care and to the particular field of toothcare kits.

BACKGROUND OF THE INVENTION

The importance of proper toothcare is well documented, both for dental hygiene as well as for general health reasons. Many dental health professionals recommend brushing after each meal, as well as in the morning and in the evening before retiring. Proper brushing not only benefits appearance, it may improve the health of the person's teeth and gums.

Recently, the benefits of proper flossing have also been recognized both for the proper care of a person's teeth, but also for the proper care of the person's gums. Dental care professionals often recommend flossing at least once a day.

However, due to travel, work or other such reasons, many people are away from home during and after meals and it may not be convenient to brush, let alone both brush and floss. This situation may occur during travel, if the hotel or motel does not have brushing implements, or if one is a guest in a home, at work, in a restaurant, or even if one is in a hospital for either a temporary or a prolonged stay. With the increased popularity of camping and other outdoor activities, the above-mentioned problems associated with proper dental health care are exacerbated because water and like necessities associated with toothcare may not be readily available. While it may not be convenient to have toothcare implements in such instances, it does not decrease the need for such implements.

Still further, many children eat at least one meal at school. As mentioned above, it is important to at least brush after each meal. Therefore, some brushing facilities should be made available to school children not only for health reasons, but to encourage such children to learn and practice proper tooth care habits.

Therefore, there is a need for a toothcare kit that can be used by someone who is away from home, yet will be convenient and will provide implements necessary for complete toothcare.

Still further, many toothbrushes may become unsanitary after many uses, or the bristles may even wear out thereby degrading the advantages obtained by brushing. Therefore, there is a need for a toothcare kit that can be disposed of after one use while still providing complete and necessary toothcare and without being unduly expensive so it can be used in offices, hospitals, hospices, elder care homes, schools and the like. If the cost is low enough, the kit can be given away by hotels, dentists, hospitals and schools. Alternatively, the kit can be sold from vending machines or the like in hotels, airports and the like.

Therefore, the art has included many designs for tooth care. These designs may include both toothpaste and dental floss, and means for dispensing these items. While these designs are often helpful in overcoming the above-mentioned problems, they still have several deficiencies. For example, once the toothbrush is used, the toothpaste may leak and become messy. This is a problem, but may be a severe disadvantage if the kit is to be used by a child and/or kept in a bag after use. The mess may discourage many from using the kit, and may deter parents from encouraging their children to use the kit. Still further, some of these kits do not adequately seal off the toothpaste prior to initial use so there may be some problem with proper storage of the kit prior to use. While some kits are stored in a container before use, such containers may be expensive and bulky. Still further, if the container is not properly closed, as may be the case if a child uses the kit, the toothpaste may leak out and become messy.

Therefore, there is a need for a disposable toothcare assembly that is inexpensive to use, neat, sanitary and securely closable before and after use.

OBJECTS OF THE INVENTION

It is a main object of the present invention to provide a disposable toothcare assembly that can be used by someone who is away from home, yet will be convenient and will provide implements necessary for complete toothcare.

It is another object of the present invention to provide a disposable toothcare assembly that is sanitary, neat self-contained and yet is still inexpensive.

It is another object of the present invention to provide a disposable toothcare assembly that remains neat between uses and prior to initial use while still being inexpensive and convenient to store.

SUMMARY OF THE INVENTION

These, and other, objects are achieved by a disposable toothcare assembly having a plurality of bristle groups mounted adjacent to one end of a handle with a dental floss dispenser located in the other end of the handle and closable means for dispensing toothpaste from the handle onto the bristles. Specifically, the closable means includes a tab slidably mounted on the handle to cover and uncover a chamber containing toothpaste. The tab is located between the chamber and the bristles and slides into and out of the handle whereby the toothpaste containing chamber can be securely covered and the dispensing holes securely closed, yet is easily and quickly opened, even by someone who has reduced manual dexterity.

The tab securely closes the toothpaste containing chamber because it is located directly over that chamber and is in contact with the handle adjacent to the dispensing holes and is securely held in place by the handle itself, and does not rely on a friction fit to close the chamber. The tab is easily removed by simply pulling on one end of the tab. Such pulling is easily carried out by children, elderly or others whose manual dexterity may be reduced from what is normally expected of adults. The tab can be replaced in chamber covering position by simply pushing it back into the handle. A simple wrapper-type covering can be used to cover the bristles because the toothpaste is securely and reliably held in the brush. This reduces the cost of the kit by eliminating the need for plastic covers or caps to cover the bristles. The secure nature of the closing effected by the tab may even permit liquid to be stored in the chamber alongside the toothpaste so the kit can be used even if no water is available.

Toothpaste is easily dispensed onto the bristles by means of a rubber button that is mounted on the handle adjacent to the toothpaste containing chamber. Pushing the button into the chamber forces toothpaste from the chamber through the dispensing holes connecting the chamber to the outside of the handle adjacent to the bristles. The button protrudes from the chamber, and thus the chamber can contain extra toothpaste in the button. The chamber closing feature associated with the tab ensures that this extra toothpaste will not vitiate the toothpaste containing feature discussed above.

Because there is a tight seal on the toothpaste, the kit of the present invention can be stored for long periods without danger of the toothpaste drying out, and can be stored in locations that may place a weight on the kit. Placing weight on the assembly, such as might occur if the assembly is carried in a backpack for camping, hunting, fishing, or the like, will not accidentally force toothpaste out of the chamber as the tab will prevent this from occurring.

BRIEF DESCRIPTION OF THE DRAWING FIGURES

DETAILED DESCRIPTION OF THE PREFERRED EMBODIMENT OF THE INVENTION

Figure 1:
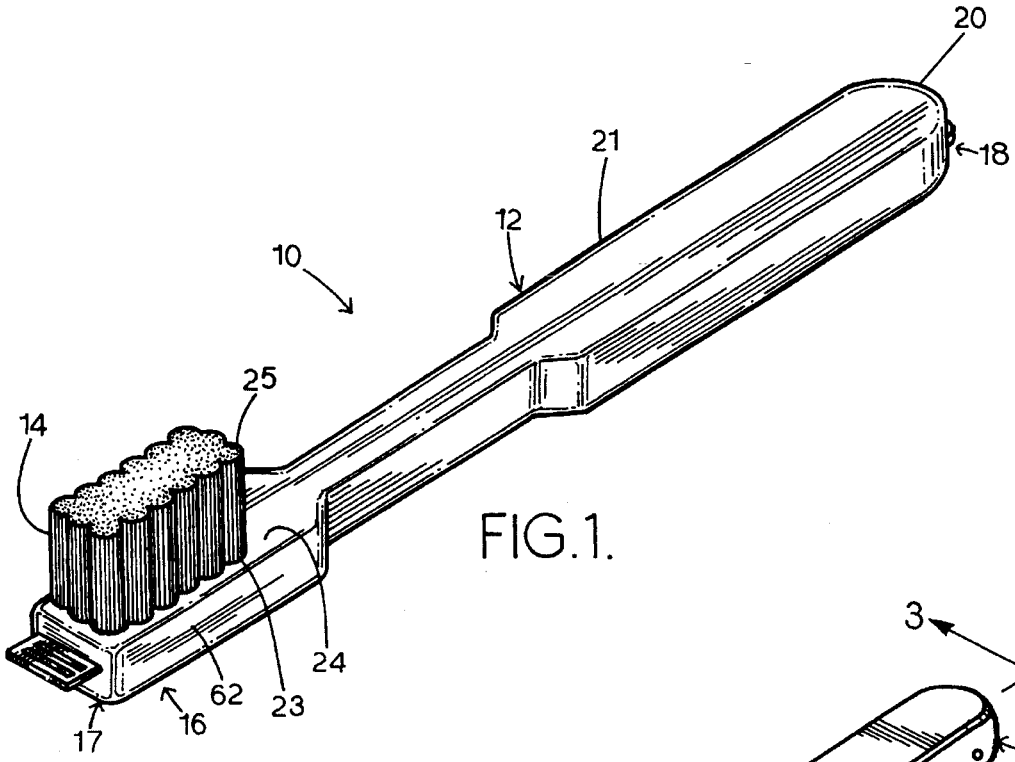
FIG. 1 is a perspective view of the disposable toothcare assembly of the present invention.
Figure 2:
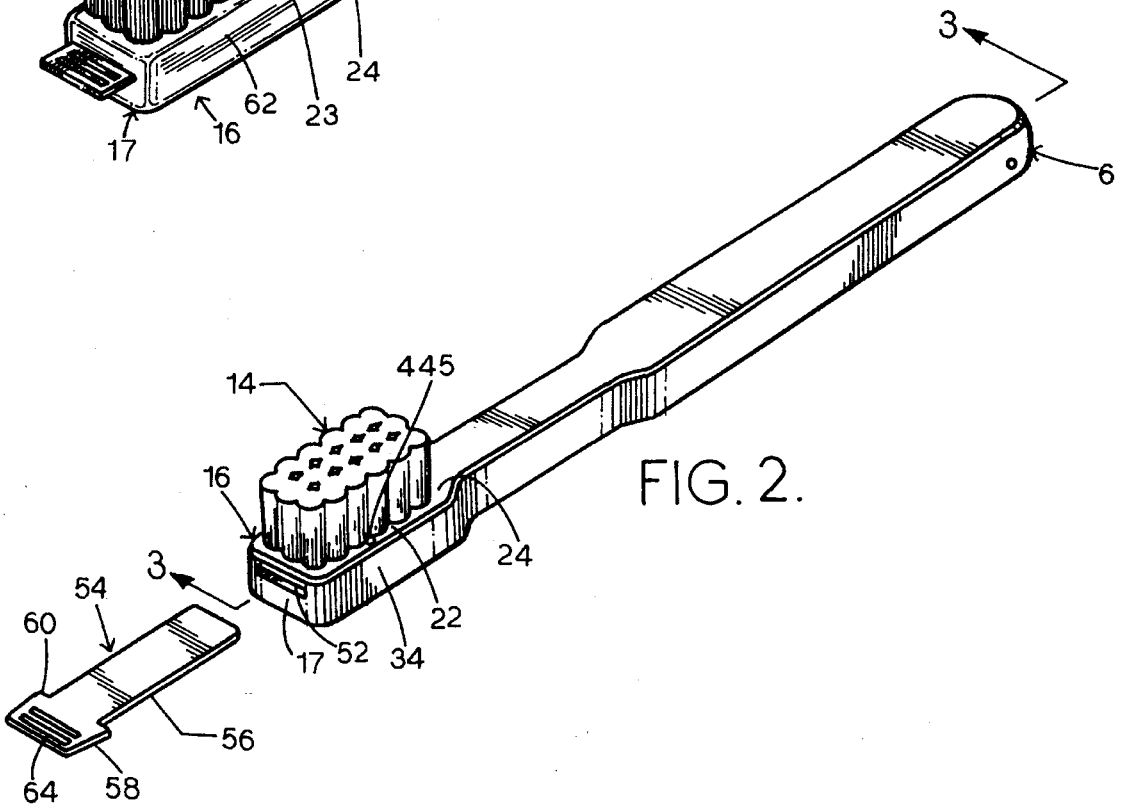
FIG. 2 is an exploded perspective view thereof.

Shown in FIG. 1 is a disposable toothcare assembly 10 embodying the present invention. Assembly 10 includes a handle 12 that can be formed of plastic or other such material, with bristles 14 mounted on head 16 adjacent to forward end 17 thereof and a dental floss dispensing means 18 in rear end 20 thereof. The handle is grasped at body section 21 which is connected to head 16 by a neck section N.

Specifically referring to FIGS. 1–5, it can be understood that bristles 14 are arranged in a plurality of groups, such as groups 14' and 14" and 14'", that are spaced apart by gaps 22 defined at the bases of the bristles. Each group of bristles will have bristles with a proximal end 23 attached to top surface 24 of the handle and a distal end 25. The bristles are in contact at their distal ends, but the groups are spaced apart at their proximal ends for a purpose that will be understood from the following discussion. As seen in top plan, the bristles resemble a normal toothbrush with the bristles in contact to effect a complete cleaning.

Assembly 10 further includes a toothpaste dispensing means in the head 16. The toothpaste dispensing means can store toothpaste securely for long periods of time, yet can dispense that toothpaste easily and neatly, yet can also easily be re-closed in a secure manner. Specifically, toothpaste dispensing means includes a chamber 30 defined in head 16 beneath the bristles and in which toothpaste 32 is stored. Head 16 includes sides 34 as well as bottom surface 36, with chamber 30 encompassing nearly the entire head area. An oval-shaped hole 38 is defined in bottom surface 36, and a rubber material element 40 is attached to the bottom surface 36 adjacent to hole 38. Element 40 extends out of head 16 to define a flexible diaphragm or button 42. Toothpaste 32 fills the chamber as well as any volume associated with the button.

Figure 3:
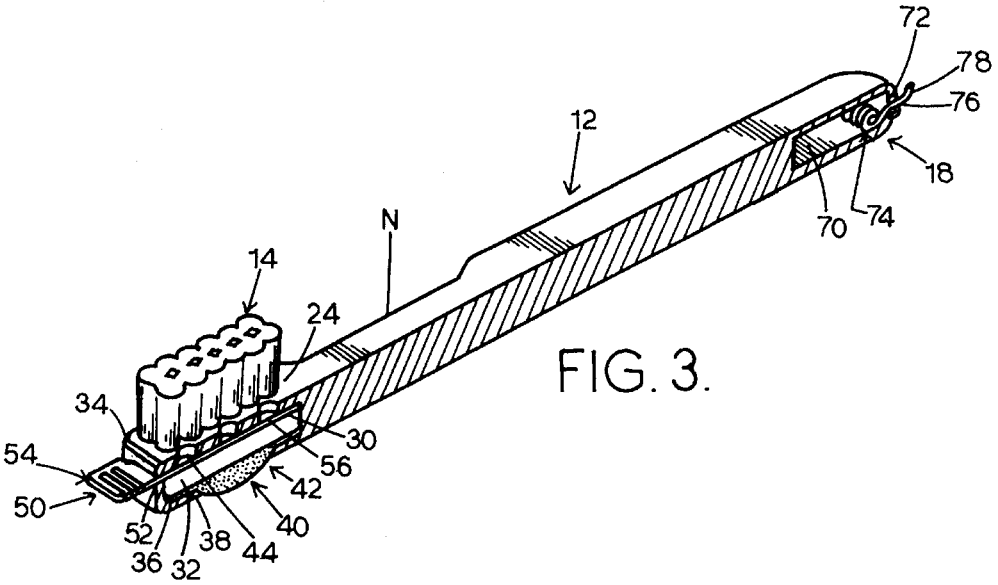
FIG. 3 is a cutaway perspective view thereof taken along line 3—3 of FIG. 2.

A plurality of toothpaste dispensing holes, such as hole 44, are defined through head 16 to connect the chamber 30 to the surface 24. Holes 44 can be arranged in any suitable pattern, including an orthogonal arrangement, or random, and are located between bristle groups. As discussed above, the bristle groups are spaced apart at their bases, and this spacing permits the holes 44 to be placed adjacent to the bristles whereby toothpaste dispensed through the holes contacts the bristles and is guided by adjacent bristle groups to the distal ends of the bristles where it can be applied to a user's teeth during a brushing procedure. As can be seen in FIG. 3, some holes, 44*s*, are located adjacent to sides 34 of head 16 so extra toothpaste can be dispensed to ensure sufficient toothpaste for any brushing.

Toothpaste is dispensed to the bristles by pressing the button 42 toward the surface 24. This decreases the volume of chamber 40 and forces toothpaste through dispensing holes 44 and 44*s*.

Toothpaste is retained in chamber 30 between uses. A chamber closure means 50 is provided in order to ensure that the toothpaste is only dispensed when desired, and not accidentally forced out of chamber 40 by accidental contact with button 40. Closure means 50 includes a tab-receiving slot 52 defined through forward end 17, and a tab 54 is slidably received in slot 52. Tab 54 includes a body section 56 and a finger-engaging section 58 connected together by a shoulder section 60 that engages head end 17 adjacent to slot 52 when the tab is fully inserted into head 16. Head 16 can include grooves, such as groove 62 defined adjacent to chamber 40 to guide tab 54 in a sliding movement. Tab 54 is moved by grasping finger-engaging portion 58, and either pulling the tab out of head 16 or pushing the tab back into the head. The tab is thus moved between a chamber closing position shown in FIG. 1 with the tab located between holes 44 and the remainder of the chamber thus closing the holes, and a chamber opening position shown in FIG. 2 with the holes 44 fully open to chamber 30 whereby toothpaste will be forced out of the chamber through the dispensing holes when button 40 is depressed. Finger gripping elements 64 are located on the tab to assist a user in manipulating the tab, and shoulder 60 engages the head to signal a user that the tab is in the chamber closing position.

Figure 4:
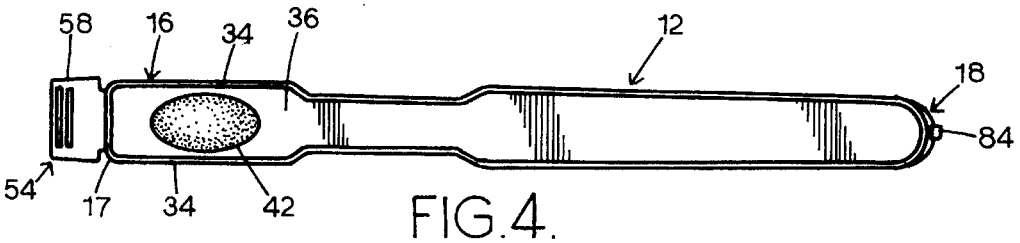
FIG. 4 is a bottom view thereof.
Figure 5:
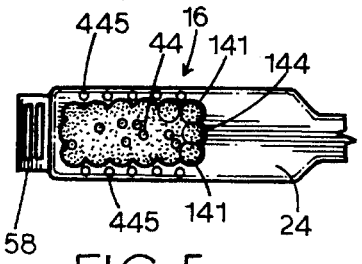
FIG. 5 is a top plan view of the head of the toothbrush illustrating the bristle groups and some of the toothpaste dispensing holes used to connect these bristles with a toothpaste storage chamber in the handle of the brush.
Figure 7:
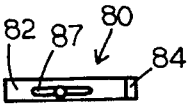
FIG. 7 is a top plan view of a knife assembly.
Figure 6:
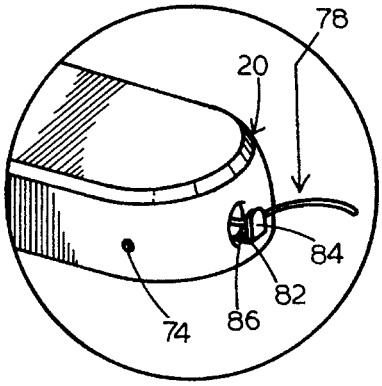
FIG. 6 is a detail of FIG. 2 showing a portion of the dental floss dispensing portion of the assembly.

As shown in FIG. 3, dental floss dispensing 18 assembly is located in handle 12 adjacent to rear end 20 and includes a chamber 70 and a dental floss dispensing hole 72 defined through end 20 and connected to chamber 70. A spool 74 containing dental floss 76 is rotatably mounted on handle 12 in chamber 70. Dental floss 76 is stored on the spool and threadably moves through hole 72 to include a free end 78 that is grasped by a user. Dental floss is pulled off spool until a suitable length of floss extends out of hole 72. The floss is then forced against a knife 80 to cut the dental floss. The dental floss portion that has been cut from the remaining dental floss is then used in the normal manner. As shown in FIGS. 6 and 7, knife 80 includes a support arm 82 connected to the handle and a blade 84 mounted on support arm 82. Floss can be wound around arm 82 between uses. Arm 82 can be slidably mounted on handle 12 by a pin 86 extending through an elongated hole 87 defined through the arm so the knife can be moved from an extended position as shown in FIG. 6 to a closed position closing hole 72 as shown in FIG. 4. This movement will prevent dental floss from accidentally being dispensed if assembly 10 is stored in a location where items could snag the floss.

It is understood that while certain forms of the present invention have been illustrated and described herein, it is not to be limited to the specific forms or arrangements of parts described and shown.

I claim:

1. A disposable toothcare assembly comprising:

A) a handle having a forward end with a top surface, a bottom surface and sides, and a rear end;

B) a multiplicity of tooth brushing bristles mounted on said handle adjacent to said forward end, said bristles being arranged in groups, with said groups being spaced apart from each other at their bases;

C) a chamber for containing toothpaste defined in said handle adjacent to said forward end and beneath said bristles;

D) means for dispensing toothpaste to said bristles including (1) a plurality of dispensing holes defined through said handle and connecting said top surface adjacent to said bristles to said chamber, said holes being located between said groups of bristles, (2) a flexible diaphragm means connected to said handle adjacent to said chamber and extending out of said chamber through said handle for storing toothpaste and for applying pressure to said chamber when pushed into said chamber and for forcing toothpaste out of said chamber through said dispensing holes, said diaphragm means including an opening defined in said bottom surface and a flexible cover attached to said handle adjacent to said opening and extending out of said opening, said flexible cover being biased outwardly of said opening and being forced toward said top surface by a user to force toothpaste out of said chamber via said dispensing holes, and (3) chamber closure means for closing said chamber and including a tab-receiving hole defined in said handle through said forward end and connecting to said chamber and a tab slidably received in said tab-receiving hole, said tab including (i) a body section located in said handle between said chamber and said dispensing holes to close said holes and prevent toothpaste from moving from said chamber into said holes when said tab is in a chamber closing position, and (ii) a means located outside of said chamber in front of said forward end for moving said tab between said chamber closing position and a chamber uncovering position with said body moved out of said chamber for uncovering said dispensing holes and permitting toothpaste to flow from said chamber into said dispensing holes;

E) a dental floss storage chamber defined in said handle adjacent to said rear end;

F) a dental floss dispensing hole defined through said handle in said rear end;

G) a spool of dental floss mounted in said dental floss storage chamber and having one end of the dental floss extending through said dental floss dispensing hole out of said dental floss storage chamber; and H) cutting means mounted on said handle rear end adjacent to said dental floss dispensing hole for cutting the dental floss, 2. The disposable toothcare assembly defined in claim 1 wherein said toothpaste dispensing holes are defined between said groups of bristles and said sides of said handle.

3. The disposable toothcare assembly defined in claim 2 wherein said diaphragm means includes a rubber element.

4. The disposable toothcare assembly defined in claim 2 wherein said tab includes a shoulder located to engage said handle forward end when said tab is in said chamber closing position.

5. The disposable toothcare assembly defined in claim 1 further including grooves defined in said handle adjacent to said chamber, said tab body section being slidably mounted in said grooves.

6. The disposable toothcare assembly defined in claim 1 wherein said cutting means includes a support arm mounted on said handle and a knife mounted on said support arm.

7. The disposable toothcare assembly defined in claim 6 further including a pin attaching said arm to said handle, an elongated slot in said arm through which said pin extends, said pin engaging said support arm adjacent to said elongated slot to hold said support arm on said handle.

* * * * *